US007802333B2

(12) United States Patent
Marguet et al.

(10) Patent No.: US 7,802,333 B2
(45) Date of Patent: Sep. 28, 2010

(54) INFLATABLE SURGICAL POSITIONING AID

(75) Inventors: L. Henri Marguet, Glen Ridge, NJ (US); Nigel E. Sharrock, New York, NY (US); Samuel Delgado, Garden City, NY (US)

(73) Assignee: O.R. Comfort, LLC, Glen Ridge, NJ (US)

( * ) Notice: Subject to any disclaimer, the term of this patent is extended or adjusted under 35 U.S.C. 154(b) by 0 days.

(21) Appl. No.: 12/029,554

(22) Filed: Feb. 12, 2008

(65) Prior Publication Data

US 2008/0189864 A1 Aug. 14, 2008

Related U.S. Application Data

(60) Provisional application No. 60/900,941, filed on Feb. 12, 2007.

(51) Int. Cl.
*A47C 20/00* (2006.01)
*A47C 16/00* (2006.01)

(52) U.S. Cl. ..... 5/644; 5/655.3

(58) Field of Classification Search ..... 73/644, 73/654, 655.3, 657, 652, 640, 639, 636, 630, 73/490; 297/397, 482; 40/649
See application file for complete search history.

(56) References Cited

U.S. PATENT DOCUMENTS

| | | | | | |
|---|---|---|---|---|---|
| 513,749 | A | * | 1/1894 | Atherton | 150/147 |
| 761,119 | A | * | 5/1904 | Weston, Jr. | 40/649 |
| 866,172 | A | * | 9/1907 | Westphall | 383/106 |
| 1,149,081 | A | * | 8/1915 | Rand | 40/649 |
| 1,368,084 | A | * | 2/1921 | Wolff | 40/649 |
| 1,533,869 | A | * | 4/1925 | Klopp | 40/649 |
| 1,564,595 | A | * | 12/1925 | Lohrer | 40/5 |
| 1,580,210 | A | * | 4/1926 | McCulloch | 5/644 |
| 3,312,987 | A | * | 4/1967 | Emery | 5/644 |
| 3,578,383 | A | * | 5/1971 | Earl | 297/391 |
| 3,608,964 | A | * | 9/1971 | Earl | 297/397 |
| 3,840,918 | A | * | 10/1974 | Shave | 5/640 |
| 3,958,690 | A | * | 5/1976 | Gee, Sr. | 206/232 |
| 4,240,543 | A | * | 12/1980 | McKee | 206/39 |
| 4,301,919 | A | * | 11/1981 | Morgan | 206/223 |
| 4,321,929 | A | * | 3/1982 | Lemelson et al. | 600/301 |
| 4,375,809 | A | * | 3/1983 | Meals | 602/13 |
| 4,393,520 | A | * | 7/1983 | Koch | 2/16 |
| 4,479,494 | A | | 10/1984 | McEwen | 606/202 |
| 4,671,290 | A | * | 6/1987 | Miller et al. | 600/494 |
| 4,683,601 | A | * | 8/1987 | Lagin | 5/652 |
| 4,815,154 | A | * | 3/1989 | Grimes | 5/657 |

(Continued)

FOREIGN PATENT DOCUMENTS

GB 2194883 A * 3/1988

*Primary Examiner*—Robert G Santos
(74) *Attorney, Agent, or Firm*—Gerald E. Hespos; Michael J. Porco

(57) ABSTRACT

A surgical positioning aid includes a n inflatable pillow with a non-inflatable sleeve. The non-inflatable sleeve has two substantially parallel attachment regions secured to a panel of the inflatable pillow and two open end portions to provide access between the non-inflatable sleeve and the inflatable pillow. The space between the non-inflatable sleeve and the inflatable pillow can be telescoped onto a surgical support post in proximity to an operating table. Air then can be directed into the inflatable pillow so that a patient can be supported relative to the post without creating pressure points on the patient.

14 Claims, 4 Drawing Sheets

U.S. PATENT DOCUMENTS 4,928,336 A * 5/1990 Petillo, Sr. ..... 5/644
5,005,866 A * 4/1991 Reedom ..... 280/801.1
5,015,036 A * 5/1991 Fergie ..... 297/397
5,016,915 A * 5/1991 Perry ..... 297/482
5,181,522 A 1/1993 McEwen ..... 600/561
5,191,665 A * 3/1993 Breedlove ..... 5/656
5,524,308 A * 6/1996 Hwang et al. ..... 5/644
5,572,757 A * 11/1996 O'Sullivan ..... 5/636
5,700,036 A * 12/1997 Smith, III ..... 283/72
5,785,388 A * 7/1998 Curtis ..... 297/482
5,941,375 A * 8/1999 Kamens et al. ..... 206/38
5,964,504 A * 10/1999 Hogan et al. ..... 297/397
6,017,094 A * 1/2000 Syiek ..... 297/482
6,050,014 A * 4/2000 Ohlson ..... 40/649
6,065,166 A 5/2000 Sharrock et al. ..... 5/630
6,086,158 A * 7/2000 Zeoli ..... 297/482
6,088,856 A * 7/2000 Boyer ..... 5/644
6,149,234 A * 11/2000 Daniels ..... 297/229
6,213,939 B1 * 4/2001 McEwen ..... 600/202
6,217,116 B1 * 4/2001 Sloot ..... 297/397
6,327,724 B1 12/2001 Sharrock et al. ..... 5/630
6,394,554 B1 * 5/2002 Hingle ..... 297/482
6,475,228 B1 11/2002 Mesaros et al. ..... 606/202
6,510,574 B2 1/2003 Sharrock et al. ..... 5/644
6,526,612 B1 * 3/2003 Zarrella ..... 5/636
6,554,363 B1 * 4/2003 Silva ..... 297/397
6,575,533 B1 * 6/2003 Kicos ..... 297/397
6,589,268 B1 7/2003 McEwen ..... 606/202
6,605,103 B2 8/2003 Hovanes et al. ..... 606/202
6,684,429 B1 * 2/2004 Deering ..... 5/644
6,830,050 B1 * 12/2004 Bamdad et al. ..... 128/845
6,918,148 B2 * 7/2005 Auxila ..... 5/655
6,957,462 B1 * 10/2005 Wilcox ..... 5/636
6,973,691 B1 * 12/2005 Cordova et al. ..... 5/652
7,140,056 B2 * 11/2006 Deering ..... 5/644
7,166,123 B2 1/2007 Hovanes et al. ..... 606/202
7,536,735 B1 * 5/2009 Stump ..... 5/632
2008/0189864 A1 * 8/2008 Marguet et al. ..... 5/644

* cited by examiner

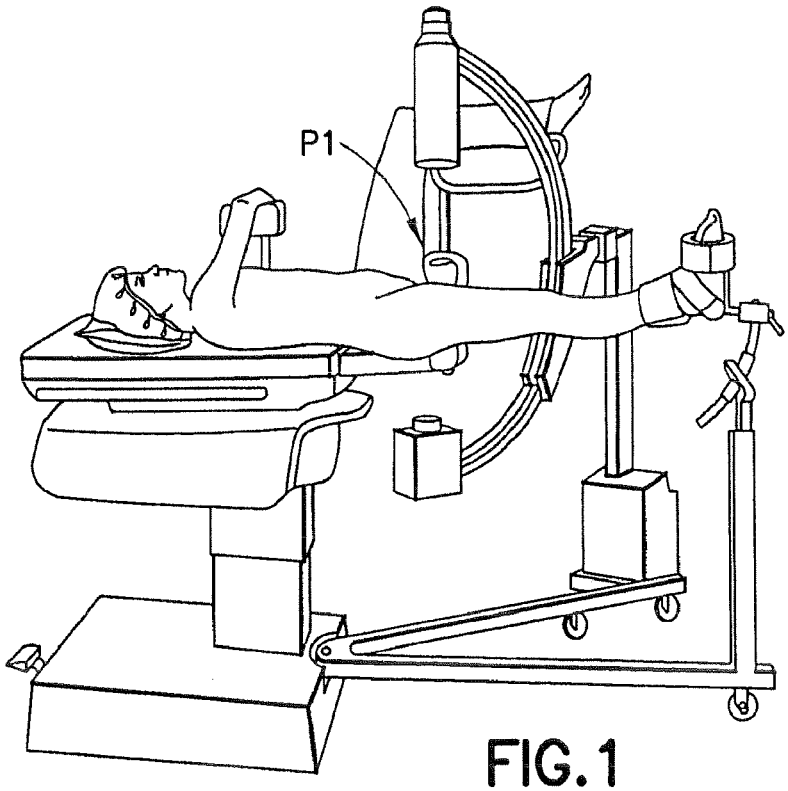
FIG. 1
PRIOR ART
FIG. 2
PRIOR ART
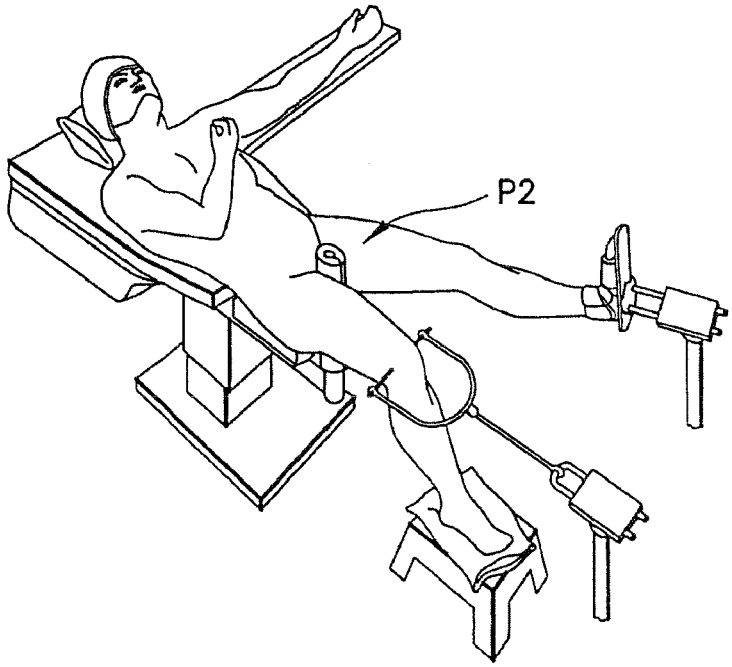

INFLATABLE SURGICAL POSITIONING AID

This application claims priority on U.S. Provisional Application No. 60/900,941 filed on Feb. 12, 2007.

BACKGROUND OF THE INVENTION

1. Field of the Invention

The invention relates to an inflatable positioning aid that can be used in an operating room so that a patient can be positioned conveniently and safely during surgery.

2. Description of the Related Art

Positioning aids are used in operating rooms for positioning and supporting a patient during surgery. In this regard, a patient generally is rendered substantially immobile during surgery and is positioned to give the doctor proper access for the surgery. However, the weight of the patient can exert pressure on blood vessels and nerves that can cause serious injuries or other medical complications. Doctors and other medical personnel are generally aware of these problems and often employ rolled up blankets or towels as padding to position a patient in a manner that will shift the weight of the patient to areas of the patient that are well suited to carrying the weight for the duration of the surgery. However, padding compresses under a load and is not adjustable. Hence accurate positioning of a patient is difficult with conventional padding. Additionally, padding is not easily repositioned if the doctor concludes that the patient is not properly oriented for the surgery. Furthermore, padding can create pressure points and can contribute to problems similar to the problems that the padding is intended to avoid.

U.S. Pat. No. 6,327,724 is assigned to the assignee of the subject application and discloses inflatable positioning aids that overcome many of the problems associated with padding and other non-inflatable positioning aids. The disclosure of U.S. Pat. No. 6,327,324 is incorporated herein by reference. Briefly, the inflatable positioning aids in U.S. Pat. No. 6,327,324 are used by initially placing an inflatable pillow in an uninflated substantially flat condition between the patient and the operating table. The size, shape and position of the inflatable pillow will be selected in accordance with characteristics of the patient and the nature of the surgery. A pump then is employed to direct air into the inflatable pillow. The patient will move in a controlled manner as air is being directed into the inflatable pillow. Thus, the weight of the patient is supported over a broad area by the inflatable pillow. Additionally, the inflatable pillow is positioned so that little or no weight is supported at critical locations, such as at locations near important blood vessels or nerves.

U.S. Pat. No. 6,327,724 discloses several different configurations for the inflatable positioning aids in accordance with specific needs for different types of surgery. In this regard, FIGS. 1-3 of U.S. Pat. No. 6,327,724 relate to a positioning aid that is particularly well suited for supporting a pregnant woman during certain obstetric procedures, such as a cesarean section. In particular, the inflatable pillow includes top and bottom sheets that are formed from nylon. The sheets are placed at least partly in registration with one another and are secured to one another about the perimeter of at least one of the sheets. The connected sheets thus define a chamber that can receive air. One of the sheets has a fitting that can be connected to an air tube of the inflatable positioning aid. The inflatable pillow further includes a non-inflatable flap that can be disposed under a portion of the patient that can support the weight of the patient without damage or injury. Air then is directed through the air tube and into the inflatable pillow. As a result, the patient will tilt into an orientation that is desirable and effective for the obstetric procedure. The non-inflatable flap prevents the pillow from displacing transversely as the air is being directed into the pillow. The inflatable positioning aid permits the doctor to gradually change the amount of tilt intra-operatively, if necessary, by adding or releasing air.

A similar inflatable positioning aid is sold by the assignee of the subject invention under the trademark SHOULDER-FLOAT™. The SHOULDER-FLOAT™ inflatable pillow is structurally and functionally similar to the above-described inflatable pillow intended for obstetric purposes. However, the SHOULDER-FLOAT™ inflatable pillow does not require a non-inflatable flap. The absence of the flap reduces cost and size. The SHOULDER-FLOAT™ inflatable pillow is positioned between an operating table and the upper torso of a person who requires shoulder surgery or any other surgery that requires the patient to be in the lateral decubitus position with the weight primarily on one shoulder. Air is directed into the SHOULDER-FLOAT™ inflatable pillow to lift the shoulder and upper torso from the operating table, thereby facilitating any surgery in the lateral decubitus portion and avoiding the above-described pressure related problems.

The above-described inflatable positioning devices are used to relieve and control pressure points between the patient and the operating table. Some surgery requires the patient to be maintained at a certain position on the plane define by the operating table or to be oriented in a certain manner on the operating table. For example, hip surgery generally requires the patient to be supported on one lateral side so that the hip that is being repaired is in a superior position and accessible to the surgeon. Accordingly, most operating tables are adapted to accommodate stabilizing posts that extend at a specified angle (e.g. vertically) and at specified position on the operating table. Examples of known stabilizing posts are identified by P1 and P2 in FIGS. 1 and 2 herein. As depicted in these figures, the operating room personal will apply padding around the stabilizing post to avoid having a hard contact point that could injure a patient. However, as explained above, padding is not very effective for eliminating pressure point and patients have been know to suffer pressure related injuries despite the use of padding on the surgical stabilizer post.

Many procedures utilize robotic devices for all or part of the surgery. Robotic devices often are moved relative to coordinates defined by X and Y axes in the plane of the operating table. Accordingly, surgeons may position a patient relative to positioning posts on the operating table so that a patient is at a known location relative to the X and Y axes defined on the operating table. Examples of these positioning posts are identified by P3 in FIGS. 3 and 4. Padding typically is used on the positioning posts P3 shown in FIGS. 3 and 4 similar to the padding used on the stabilizer post P1 and P2 shown in FIGS. 1 and 2. However, the padding used on the prior art positioning post P3 shown in FIGS. 3 and 4 can create pressure related injuries to the patient.

Some surgery, such as surgery on a limb, requires the use of a tourniquet to prevent excessive intraoperative blood loss. Most surgical tourniquets use pneumatic pressure to control the restriction on the blood flow in the limb. The pneumatic pressure in the prior art surgical tourniquet is controlled by a "tourniquet box" that communicates with both a source of air and the tourniquet. The tourniquet box includes an input device for inputting required tourniquet pressure requirements, an output display, sensors for sensing actual pressure in the tourniquet, and a control processor or server for controlling the operation of the tourniquet box. Surgical tourniquets are available from Instrumed, Inc. of Redmond, Wash.

and from others, and tourniquet controls are shown in U.S. Pat. No. 7,166,123, U.S. Pat. No. 6,605,103, U.S. Pat. No. 6,589,268, U.S. Pat. No. 6,475,228, U.S. Pat. No. 5,181,522 and U.S. Pat. No. 4,479,494. The disclosures of these patents are incorporated herein by reference.

The subject invention was made in view of the above-identified problems with stabilizer posts or positioning posts that extend upwardly from or near the operating table to position a patient.

SUMMARY OF THE INVENTION

The invention relates to an inflatable positioning aid for at least partly positioning and supporting a patient in an operating room or other medical environment. The inflatable positioning aid includes an inflatable pillow and means for directing air into the inflatable pillow. The inflatable positioning aid further includes a valve for selectively releasing air from the inflatable pillow.

The inflatable pillow includes a non-inflatable sleeve connected to spaced apart attachment points on the inflatable pillow. Thus, the non-inflatable sleeve has a section between the spaced apart attachment points that is not secured to the inflatable pillow. With this design, the inflatable positioning aid can be mounted over a stabilizing post or positioning post of an operating table by urging the stabilizer post or positioning post into the space between the inflatable pillow and the non-inflatable sleeve. Air then can be directed into the inflatable pillow to achieve the appropriate pressure level in the pillow for providing a desired degree of cushioning between the patient and the stabilizing post or positioning post. Accordingly, the inflatable positioning aid stabilizes the patient and distributes the pressure on the patient to avoid or minimize the possibility of nerve damage, vessel damage or visceral damage.

The inflatable positioning device preferably includes inflation tubing that communicates with the inflatable pillow and a stopcock valve incorporated into the inflation tubing. The stopcock valve has an exit port that may be attached to a tourniquet box adaptor for connecting the inflatable pillow and the inflation tubing to a tourniquet box. The tourniquet box has means for controlling pressure of air that can be delivered to a tourniquet, or in this instance to the inflatable positioning aid. The pressure control means of the tourniquet box is set to achieve the desired level of pressure for the inflatable pillow. This pressure can be maintained constantly by the tourniquet box server system to ensure that the pressure applied against the body never exceeds the set pressure despite possible shifting of the patient during surgery. Accordingly, injuries nerve and other pressure-related injuries can be avoided.

BRIEF DESCRIPTION OF THE DRAWINGS

FIG. 1 is a side elevational view of one example of a prior art surgical stabilizing post.

FIG. 2 is a perspective view of a prior art surgical stabilizing post.

DETAILED DESCRIPTION OF THE PREFERRED EMBODIMENTS

Figure 3:
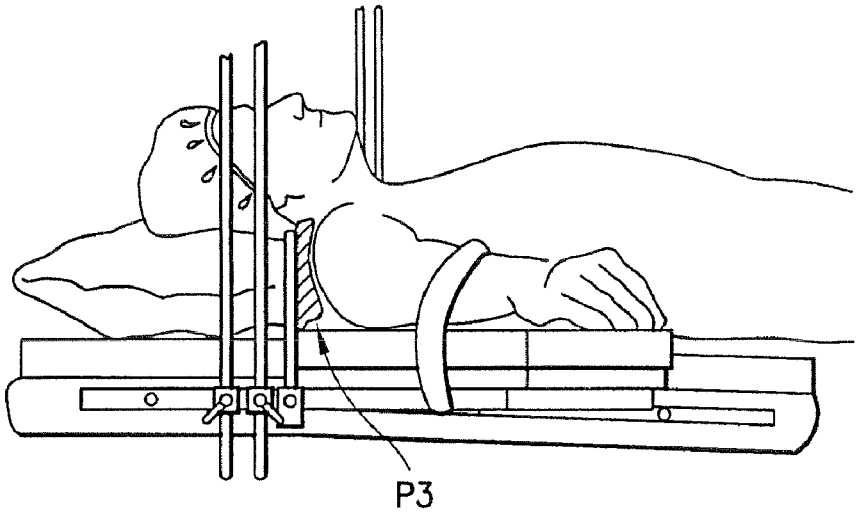
FIG.3 PRIOR ART
FIG. 3 is a side elevational view of a prior art surgical positioning post.
Figure 4:
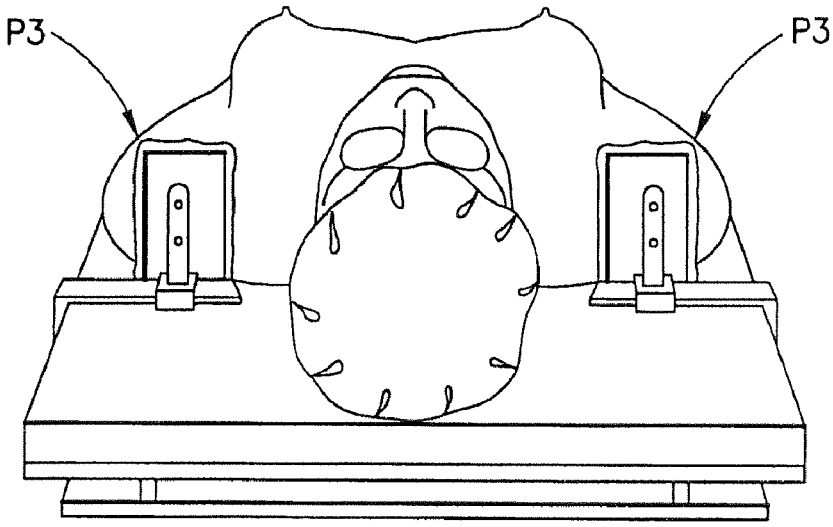
FIG.4 PRIOR ART
FIG. 4 is an end elevational view of the prior art surgical positioning post shown in FIG. 3.
Figure 5:
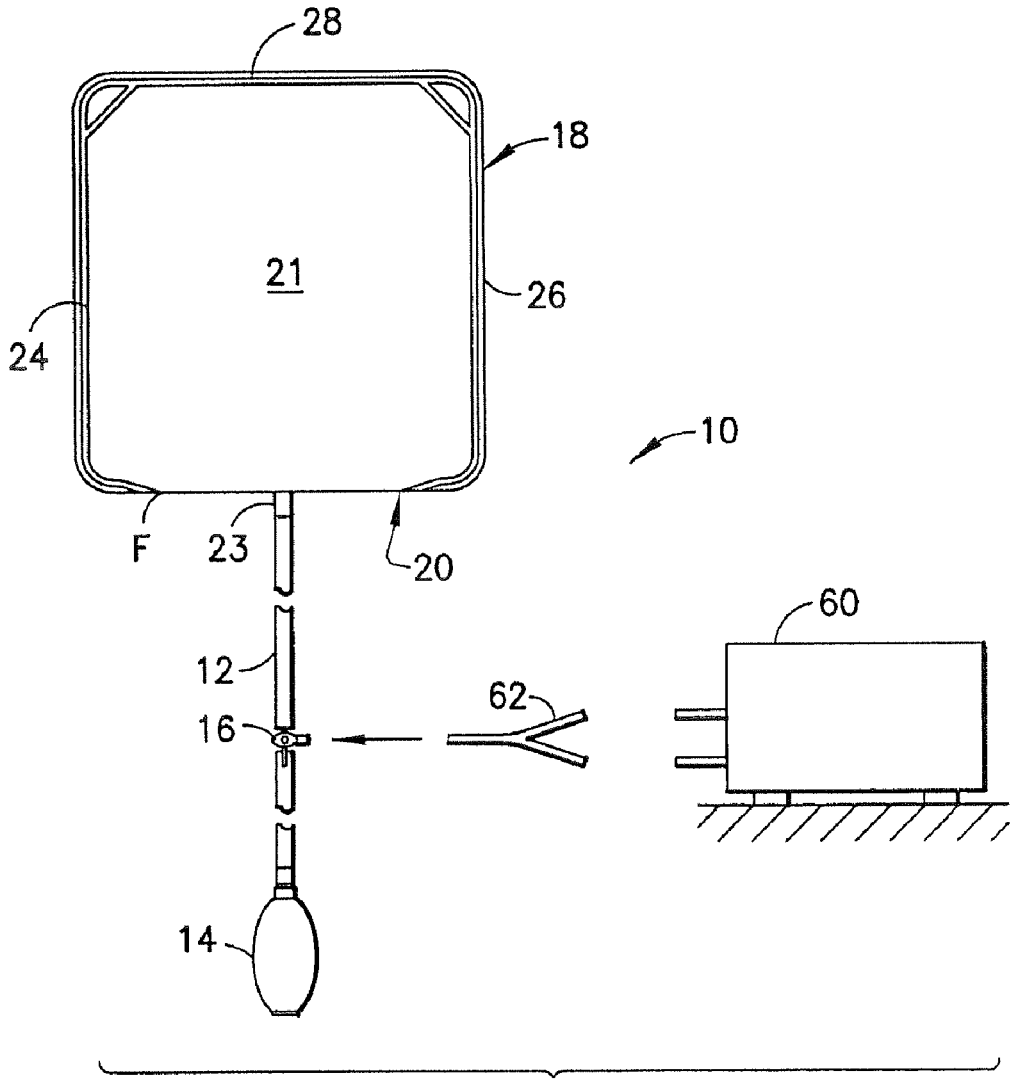
FIG. 5 is a front elevational view of a surgical positioning aid in accordance with the subject invention.
Figure 6:
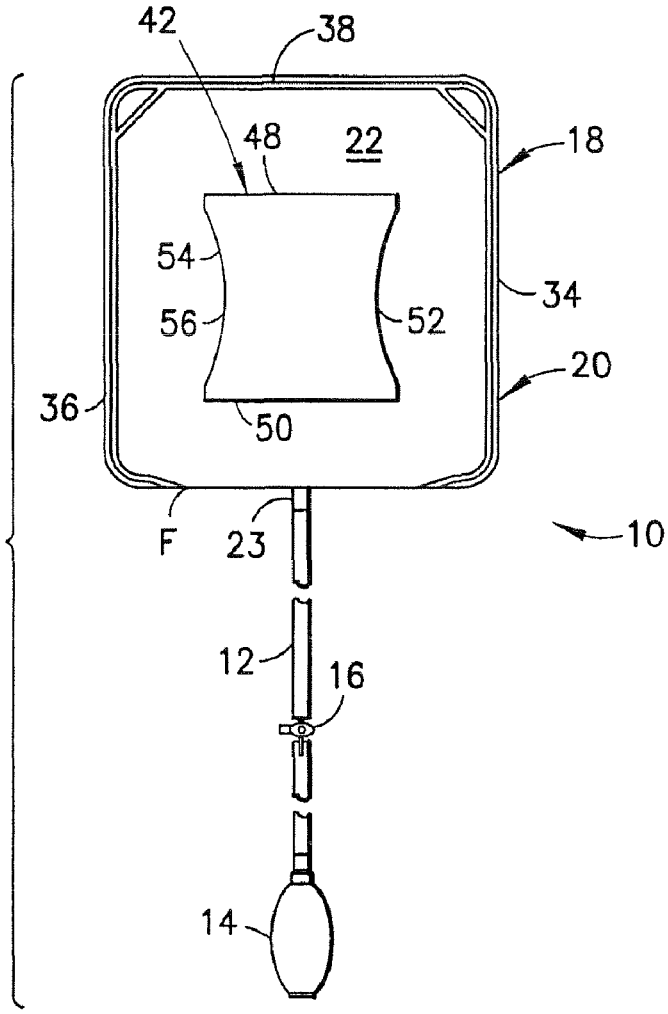
FIG. 6 is a rear elevational view of the surgical positioning aid of FIG. 5.
Figure 7:
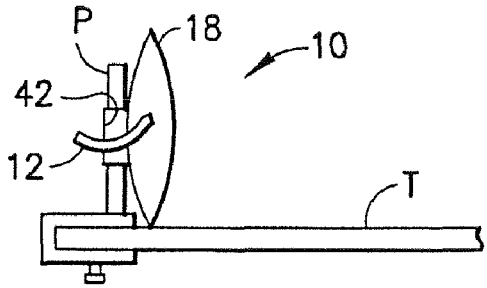
FIG. 7 is an end elevational view showing the positioning aid mounted on a post.

An inflatable positioning apparatus in accordance with the subject invention is identified generally by the numeral 10 in FIGS. 5-7. The inflatable positioning apparatus 10 includes a tube 12, a pump 14 and a valve 16. In addition to the valve 16, the pump 14 is provided with two one-way valves (not shown). The first one-way valve is operative to permit air to flow from the pump 14 to the tube 12 each time the pump 14 is manually squeezed. However, this first one-way valve prevents a return flow of air from the tube 12 into the pump 14. The second one-way valve permits air flow from the ambient environment into the pump 14 as the pump 14 resiliently expands from the squeezed condition to the expanded condition. This second one-way valve, however, prevents an outflow of air from the pump to the ambient environment. The tube 12, the pump 14 and the valve 16 all may be of prior art design.

The positioning apparatus 10 further includes an inflatable pillow 18 connected to the end of the flexible tube 12 remote from the pump 14. The inflatable pillow 18 is formed from an elongate substantially rectangular sheet 20 that is folded in half about a fold F to define first and second registered panels 21 and 22. The sheet 20 is formed from a nylon material with a thickness in the range of 70-400 denier, and preferably about 200 denier. One surface of the sheet 20 is laminated with a layer of urethane that has a thickness of approximately 3.5 mil and the opposite surface of the sheet 20 may have a kiss coat of urethane to a thickness that may be in the range of 0.0025-0.0050 inch. The sheet 20 is folded so that the approximately 3.5 mil layer of urethane faces in on the pillow 18 and so that the kiss coating faces out on the pillow 18. The kiss coating of urethane on the outer surface of the pillow 18 provides a fluid repellency to the inflatable pillow. In particular, the kiss coating of urethane seals the nylon material of the sheet 20 and at least partly smoothes out the peaks and valleys inherently present in the nylon. As a result, fluids, such as blood or sweat that may be generated during the medical procedure will be repelled.

A fitting 23 is mounted to the inflatable pillow 18 substantially at the fold F that joins the panels 21 and 22. The fitting 23 may include a flange and a cylindrical portion extending from the flange. The cylindrical portion is passed through an aperture formed in the sheet 20 at the fold F such that the flange abuts the inner surface of the inflatable pillow 18 at the F. The flange of the fitting 21 then is RF welded to the urethane-coated inner surface of the sheet 200*r* is adhered in position.

The first panel 21 has substantially parallel top and bottom edges 24 and 26 and a side edge 28 that extends parallel to the fold F between the top and bottom edges 24 and 26. The second panel 22 also has substantially parallel top and bottom edges 34 and 36 and a side edge 38 extending between the top and bottom edges 34 and 36 and parallel to the fold F. The second panel 22 is folded onto the first panel 21 so that the respective edges register with one another. Areas of the first panel 21 adjacent the edges 24-28 and the corresponding areas of the second panel 22 adjacent the edges 34-38 then are subjected to an RF welding apparatus that welds the first panel 21 to the second panel 22 around their peripheries from the opposite ends of the fold F. The RF welding apparatus applies pressure and radio frequency energy that causes the urethane lamination on the inner surfaces to bond the two panels 21 and 22 together around their peripheries. Thus, an inflatable region is defined between the panels 21 and 22 and within the area bounded by the peripheries of the panels 21 and 22.

A non-inflatable sleeve 42 is secured by RE welding to the outer surface of the second panel 22 as shown most clearly in FIG. 6. The kiss coating of urethane on the outer surface of the second panel 22 enables the RF welding process and avoids the use of adhesive. Preferably the RF welding of the non-inflatable sleeve 42 is carried out simultaneously with the RF welding of the flange of the fitting 23 to the urethane-coated inner surface of the sheet 20 before the sheet 20 is folded about the fold F. The peripheral regions of the panels 21 and 22 then are secured together in a subsequent RF welding process after the sheet 20 is folded about the fold F. The non-inflatable sleeve 42 is secured to the second panel 22 at spaced apart first and second substantially linear attachments regions 48 and 50. The first attachment region 48 is substantially parallel to and near the side edge 38 of the second panel 22. Similarly, the second attachment region 50 of the sleeve 42 is parallel to and near the fold F between the first and second panels 21 and 22. Thus, the second attachment region 50 is substantially parallel to the first attachment region 48. The non-inflatable sleeve 42 further includes top and bottom free edges 52 and 54 that extend between the attachments regions 48 and 50. The top and bottom free edges 52 and 54 are approximately equally spaced from the respective top and bottom edges 34 and 36 of the second panel 22. Additionally, the top and bottom free edges 52 and 54 each are smoothly arcuately concave. Thus, the distance between the free top edge 52 of the non-inflatable sleeve 42 and the top 34 of the second panel 22 is greatest at locations approximately centrally between the first and second attachments regions 48 and 50. Similarly, the distance between the bottom free edge 54 and the bottom edge 36 of the second panel 22 is greatest at locations approximately centrally between the first and second attachments regions 48 and 50. A continuous post-mounting channel 56 is defined between the non-inflatable sleeve 42 and the inflatable pillow 18 in areas between the attachments regions 48 and 50. As a result, the channel 56 can be telescoped over the surgical stabilizing post or positioning post P shown in FIG. 7 or any other such positioning post aligned vertically, horizontally or at any acute angle relative to the top surface of the operating table T. The concave shapes of the top and bottom free edges 52 and 54 of the non-inflatable sleeve 42 facilitate the telescoping of the positioning post P into the channel 56. The inflatable pillow 18 preferably is oriented on the post P so that the fold F, the fitting 23 and the tube 12 are extending away from the region on the patient that will be worked on by the medical staff. As a result, the positioning apparatus 10 will not interfere with the surgery.

Air may be directed into the inflatable pillow 18 by manually actuating the hand pump 14 to achieve a desired pressure between the surgical stabilizing post or positioning post and the patient. However, the preferred positioning device further is used with a tourniquet box identified generally by the numeral 60 and a tourniquet box adaptor identified by the numeral 62 in FIG. 5. The tourniquet box 60 may be a commercially available unit that generally is used for applying pressure to a tourniquet for controlling blood flow in an injured limb or in a limb that is subject to surgery. For example, the tourniquet box 60 may be one of those disclosed in the above-identified patents, the disclosures of which have been incorporated by reference. In this regard, the tourniquet box 60 includes means for directing compressed air to a tourniquet, a server for maintaining a set pressure level and an input device for setting and changing the pressure. The tourniquet box 60 is set to an appropriate pressure level for the inflatable pillow 18 and cooperates with the pillow 18 via the tourniquet box adaptor 62 for ensuring that the pressure applied between the patient and the surgical stabilizing post or positioning post P does not exceed the set pressure level. The pressure level set for the tourniquet box 60 should be between 20-200 mm of mercury pressure, and preferably between 35 and 100 mm of mercury pressure. In most instances, a pressure level of about 40 mm mercury pressure is appropriate.

While the invention has been defined with respect to certain preferred embodiments, it is apparent that various changes can be made without departing from the scope of the invention. In this regard, the non-inflatable sleeve may be connected to the inflatable pillow at more edges of the panels of the pillow. Additionally, the pillow can take forms others than the rectangular shape shown in the figures and the attachments of the inflation tubing can be at other locations on the pillow.

What is claimed is:

1. An inflatable surgical positioning aid comprising, an inflatable pillow having first and second substantially registered panels secured to one another to define an inflatable enclosure therebetween, means for delivering air into the inflatable enclosure, and a non-inflatable sleeve having first and second spaced apart permanent attachment regions securely and permanently affixed to the second panel and first and second free edges extending between the first and second permanent attachment regions for defining a post-receiving channel between the non-inflatable sleeve and the inflatable pillow, wherein the free edges of the non-inflatable sleeve are concave and are nearer to one another at locations spaced from the attachment regions of the non-inflatable sleeve.

2. The surgical positioning aid of claim 1, wherein the attachment regions of the non-inflatable sleeve to the second panel are spaced inwardly from peripheral edges of the second panel.

3. The surgical positioning aid of claim 2, wherein the attachment regions of the non-inflatable sleeve are substantially parallel to at least one peripheral edge of the second panel.

4. The surgical positioning aid of claim 1, wherein the first and second free edges of the non-inflatable sleeve are spaced inwardly from peripheral edges of the second panel.

5. The surgical positioning aid of claim 1, wherein the non-inflatable sleeve is disposed substantially symmetrically on the second panel and spaced inwardly from peripheral edges of the second panel.

6. The surgical positioning aid of claim 1, wherein the means for delivering air into the inflatable pillow comprises a fitting extending into the side edge of the pillow aligned parallel to the attachment regions of the non-inflatable sleeve.

7. The surgical positioning aid of claim 1, wherein the first and second panels of the inflatable pillow are joined unitarily to one another along a fold, the means for delivering air into the inflatable pillow being disposed along the fold, the fold being substantially parallel to the attachments regions of the non-inflatable sleeve.

8. A surgical positioning aid for positioning a patient in proximity to a post projection from an operating table, the surgical positioning aid comprising:

an inflatable pillow having first and second substantially registered panels secured to one another to define an inflatable enclosure therebetween;

a fitting extending into communication with the inflatable pillow;

a non-inflatable sleeve having first and second substantially parallel permanent attachment regions securely and permanently attached to the inflatable pillow, all portions of the non-inflatable sleeve between the first and second permanent attachment regions being opposed to the inflatable pillow, but unconnected to the inflatable pillow, the non-inflatable sleeve having free edges substantially opposite one another and extending between the first and second permanent attachment regions, the first and second permanent attachment regions being spaced sufficiently apart to permit the post to be inserted between the non-inflatable sleeve and the inflatable pillow;

air communication means connectable to the fitting for selectively delivering air through the fitting and into or out of the inflatable pillow;

wherein the first and second panels of the inflatable pillow are joined unitarily to one another along a fold, the means for delivering air into the inflatable pillow being disposed along the fold, the fold being substantially parallel to the attachment regions of the non-inflatable sleeve and wherein the free edges of the non-inflatable sleeve are curved concavely to approach one another at distances spaced from the attachment regions of the non-inflatable sleeve for facilitating insertion of the post into the space between the non-inflatable sleeve and the inflatable pillow.

9. The surgical positioning aid of claim 8, wherein the air communication means is a tourniquet box operative for maintaining a substantially constant air pressure in the inflatable pillow.

10. The surgical positioning aid of claim 8, wherein the non-inflatable sleeve is disposed substantially symmetrically on the second panel and spaced inwardly from peripheral edges of the second panel.

11. A surgical positioning aid for positioning a patient on an operating table, the surgical positioning aid comprising:

a post projecting from the operating table;

an inflatable pillow having first and second substantially registered panels secured to one another to define an inflatable enclosure therebetween;

a fitting extending into communication with the inflatable pillow;

a non-inflatable sleeve having first and second substantially parallel permanent attachment regions securely and permanently attached to the inflatable pillow, all portions of the non-inflatable sleeve between the first and second permanent attachment regions being opposed to the inflatable pillow, but unconnected to the inflatable pillow, the non-inflatable sleeve having free edges substantially opposite one another and extending between the first and second permanent attachment regions, the first and second permanent attachment regions being spaced sufficiently apart to permit the post to be inserted between the non-inflatable sleeve and the inflatable pillow;

air communication means connectable to the fitting for selectively delivering air through the fitting and into or out of the inflatable pillow; and wherein the first and second panels of the inflatable pillow are joined unitarily to one another along a fold, the means for delivering air into the inflatable pillow being disposed along the fold, the fold being substantially parallel to the attachment regions of the non-inflatable sleeve.

12. The surgical positioning aid of claim 11, wherein the air communication means is a tourniquet box operative for maintaining a substantially constant air pressure in the inflatable pillow.

13. The surgical positioning aid of claim 11, wherein the free edges of the non-inflatable sleeve are curved concavely to approach one another at distances spaced from the attachment regions of the non-inflatable sleeve for facilitating insertion of the post into the space between the non-inflatable sleeve and the inflatable pillow.

14. The surgical positioning aid of claim 13, wherein the non-inflatable sleeve is disposed substantially symmetrically on the second panel and spaced inwardly from peripheral edges of the second panel.

* * * * *